US010161116B2

(12) United States Patent
Frye

(10) Patent No.: US 10,161,116 B2
(45) Date of Patent: Dec. 25, 2018

(54) KITCHEN FAUCET PULLDOWN WEIGHT

(71) Applicant: Kohler Co., Kohler, WI (US)

(72) Inventor: Jacob R. Frye, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 15/272,161

(22) Filed: Sep. 21, 2016

(65) Prior Publication Data

US 2018/0080203 A1 Mar. 22, 2018

(51) Int. Cl.
*E05F 1/00* (2006.01)
*E03C 1/04* (2006.01)

(52) U.S. Cl.
CPC ..... *E03C 1/04* (2013.01); *E03C 2001/0415* (2013.01); *E03C 2001/0417* (2013.01)

(58) Field of Classification Search
CPC ... Y10T 16/82; Y10T 16/95; Y10T 137/9464; Y10T 24/39; Y10T 24/3918; A63B 69/3638; A63B 69/3632; A53B 15/005; E03C 1/04; E03C 2001/0415; E03C 2001/10417; A01K 95/02; A01K 91/03
See application file for complete search history.

(56) References Cited

U.S. PATENT DOCUMENTS 1,848,600 A * 3/1932 Best ..... A01K 95/00 43/43.1
1,883,574 A * 10/1932 Cleeland ..... A01K 95/00 43/43.1
4,932,702 A * 6/1990 Sweeny ..... A45F 5/1046 294/171
5,195,563 A 3/1993 Brooks
5,388,368 A * 2/1995 Lawrence ..... A01K 91/03 43/44.89
5,771,934 A 6/1998 Warshawsky
5,960,832 A 10/1999 Warshawsky
6,076,560 A 6/2000 Stähle et al.
6,250,338 B1 6/2001 Dempsey
6,460,570 B1 10/2002 Jones et al.
6,497,006 B2 * 12/2002 Gallup ..... A45F 5/102 16/110.1
6,554,233 B1 4/2003 Ungerecht
6,915,817 B2 7/2005 Benstead et al.
7,048,640 B2 * 5/2006 Light ..... A63B 69/3638 473/226
7,143,780 B1 12/2006 Pitts
7,614,179 B2 * 11/2009 Kavanaugh ..... A01K 91/03 24/130
7,877,924 B2 * 2/2011 Schoenike ..... A01K 91/16 43/43.1
8,578,562 B2 11/2013 Liu et al.
8,720,105 B2 * 5/2014 Schoenike ..... A01K 91/16 43/43.1
9,004,096 B2 4/2015 Gilbert
2009/0013585 A1 * 1/2009 Acworth ..... A01K 95/02 43/44.89
2009/0145492 A1 6/2009 Thomas et al.
2014/0209187 A1 * 7/2014 Ho ..... E03C 1/0404 137/315.01
2014/0261836 A1 9/2014 Budagher et al.

(Continued)

*Primary Examiner* — Chuck Y Mah
(74) *Attorney, Agent, or Firm* — Foley & Lardner LLP

(57) ABSTRACT

A weight for a faucet hose includes a body defining a channel extending therethrough, the channel having a non-linear axis, wherein the channel is configured to receive and frictionally engage a hose.

16 Claims, 5 Drawing Sheets

(56) References Cited

U.S. PATENT DOCUMENTS

| | | | | |
|---|---|---|---|---|
| 2015/0113767 | A1 | 4/2015 | Yuan et al. | |
| 2015/0233097 | A1* | 8/2015 | Yang | E03C 1/0404 16/400 |
| 2016/0090719 | A1* | 3/2016 | Nelson | E03C 1/04 137/315.01 |

* cited by examiner

KITCHEN FAUCET PULLDOWN WEIGHT

BACKGROUND

The present application relates generally to the field of kitchen fixtures. In particular, the present application relates to a pulldown weight for retracting a sprayhead into a spout for docking.

Conventionally, a pulldown weight may use screws, clam shells that snap together, or fasteners (e.g., zip ties) to fasten the weight to a hose. Weights that use screws and clam shells require multiple parts and the use of tools in a location (e.g., under a sink) that is difficult to access. Additional parts may include a foam pad for compressing the hose. Alternatively, using fasteners may limit the adjustability of a weight on the hose, or may compress the hose, reducing flow through the hose.

SUMMARY

One embodiment relates to a weight for a faucet hose, including a body defining a channel extending therethrough, the channel having a non-linear axis, wherein the channel is configured to receive and frictionally engage a hose.

Another embodiment relates to a faucet assembly, including a weight defining a channel extending therethrough, the channel including a first portion, a second portion extending angularly from the first portion, a third portion extending angularly from the second portion and axially offset from the first portion. The channel further includes a first inner radius defined between the first portion and the second portion, and a second inner radius defined between the second portion and the third portion, the second inner radius opposing the first inner radius. The faucet assembly further includes a hose received in and frictionally engaging the channel at the first inner radius and the second inner radius.

Another embodiment relates to a method of making a faucet hose with a weight, including bending the hose, such that the hose forms a first profile generally complementary to a non-linear channel defined in a front surface of the weight, and passing the hose through the front surface into the channel. The method further includes releasing the hose, such that the hose rebounds into a second profile configured to engage the channel, wherein the second profile is more linear than the first profile.

DETAILED DESCRIPTION

Referring generally to the FIGURES, a faucet having a pulldown weight is shown according to an exemplary embodiment. The faucet includes a body, a spout, and a sprayhead releasably coupled to the spout. A hose carries fluid through the spout to the sprayhead, where the fluid is ejected (e.g., released, sprayed, output) to the environment, for example, into a basin, sink, tub, or shower stall.

Figure 1A:
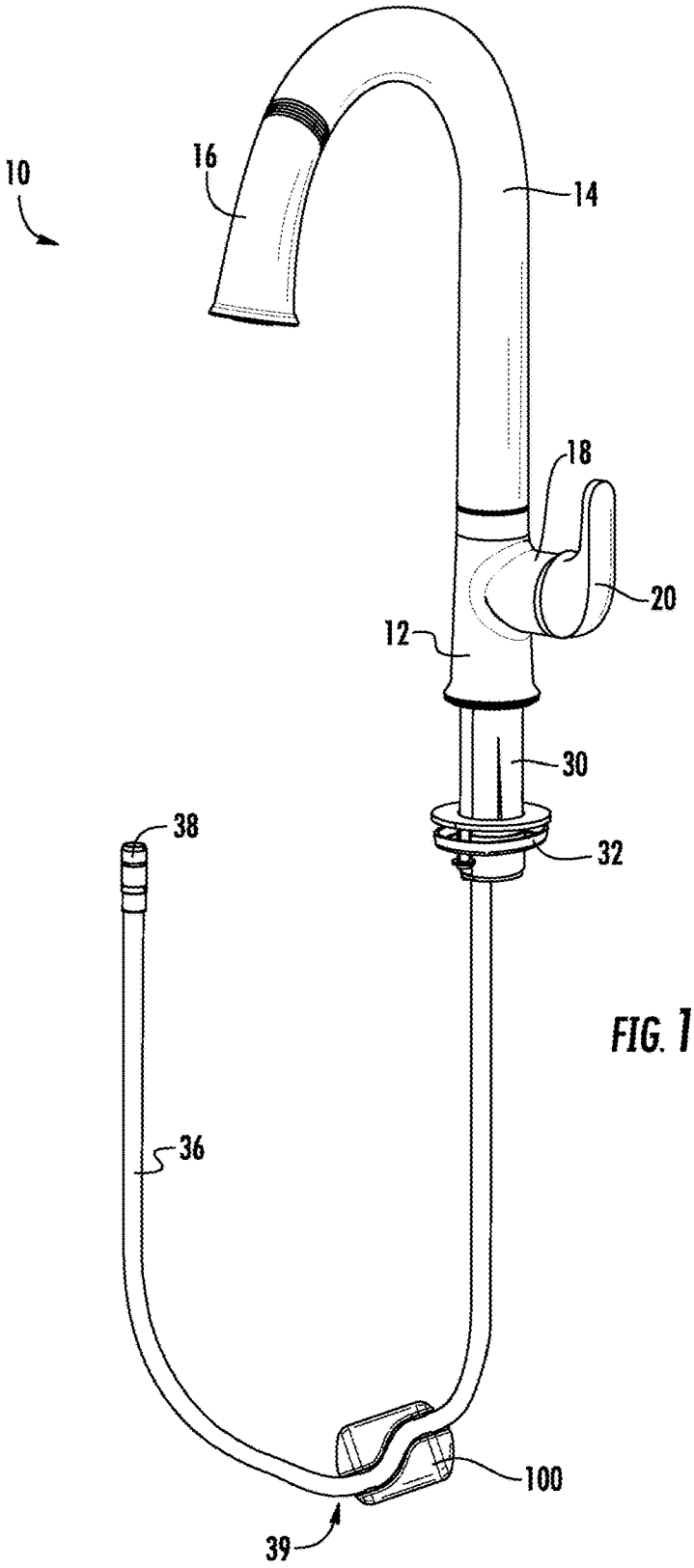
FIG. 1A is a perspective view of a faucet with a sprayhead in a docked position.
Figure 1B:
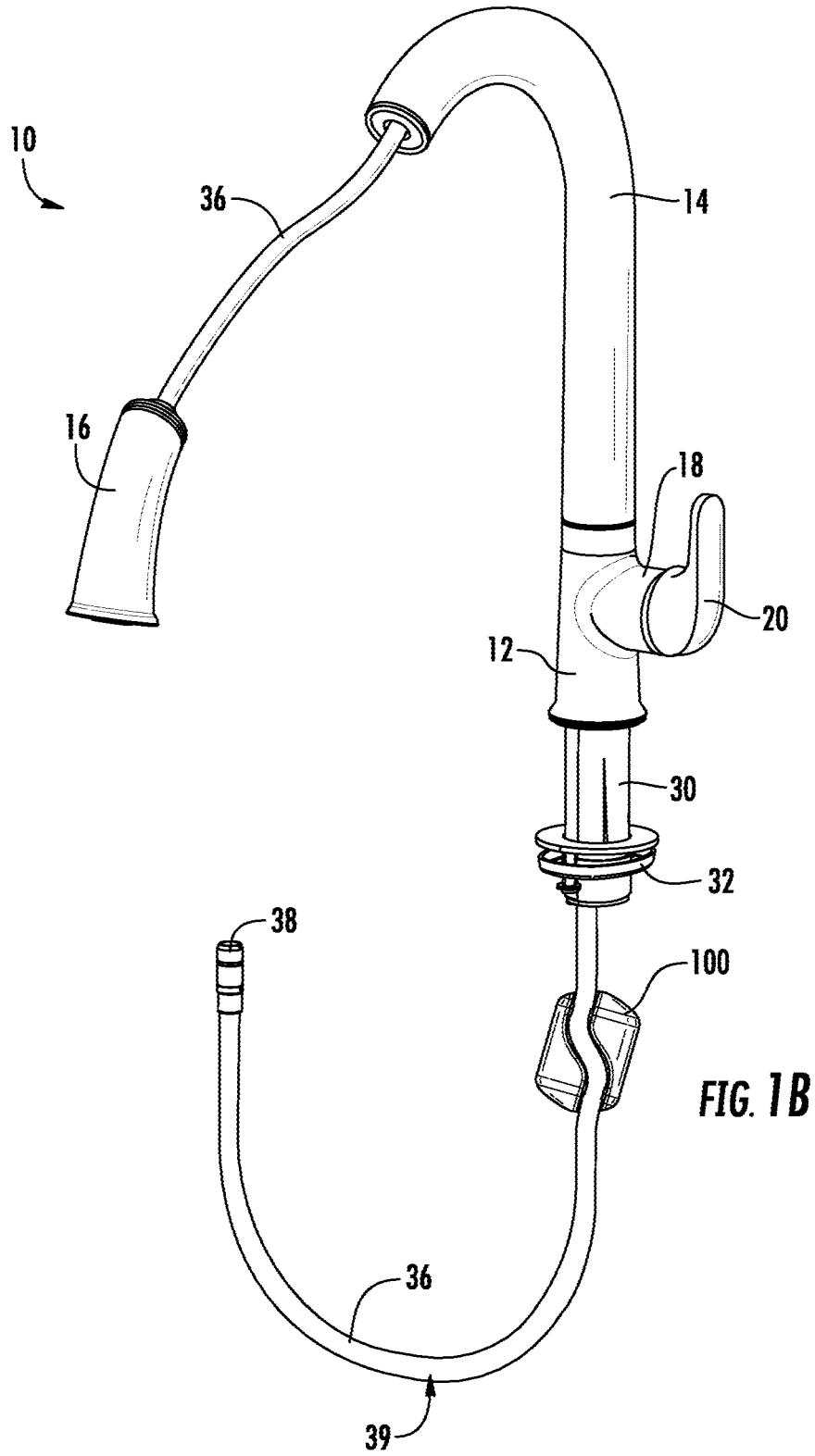
FIG. 1B is a perspective view of the faucet of FIG. 1A with the sprayhead in an undocked position.

The faucet shown in FIG. 1A is shown in a first or docked position, in which the sprayhead is coupled to and received in the spout. The faucet shown in FIG. 1B is shown in a second or undocked position. In the undocked position, the sprayhead is decoupled and spaced apart from the spout. In such a position, the hose is at least partially withdrawn from the spout. According to the embodiments shown, a pulldown weight is configured to retract the sprayhead from the undocked position to the docked position.

Referring to FIGS. 1A and 1B, a faucet with a retractable spout is shown, according to an exemplary embodiment. A faucet 10 includes a base 12, a spout 14, and a sprayhead 16 releasably coupled to (e.g., received in, engaging, etc.) the spout 14. The faucet 10 is shown to include an arm 18 configured to house and support a manual valve (not shown). The valve may be configured to control the volume, temperature, or some combination thereof, of the fluid (e.g., water, beverage, etc.) flow through the faucet 10. A handle 20 is coupled to the valve to control the operation thereof. According to other embodiments, the faucet 10 may not include an arm 18, and the valve and handle 20 may be located remotely from the faucet 10. According to various other embodiments, the faucet 10 may include an electronically controlled valve (e.g., solenoid valve) in addition to or instead of the manual valve.

Figure 2:
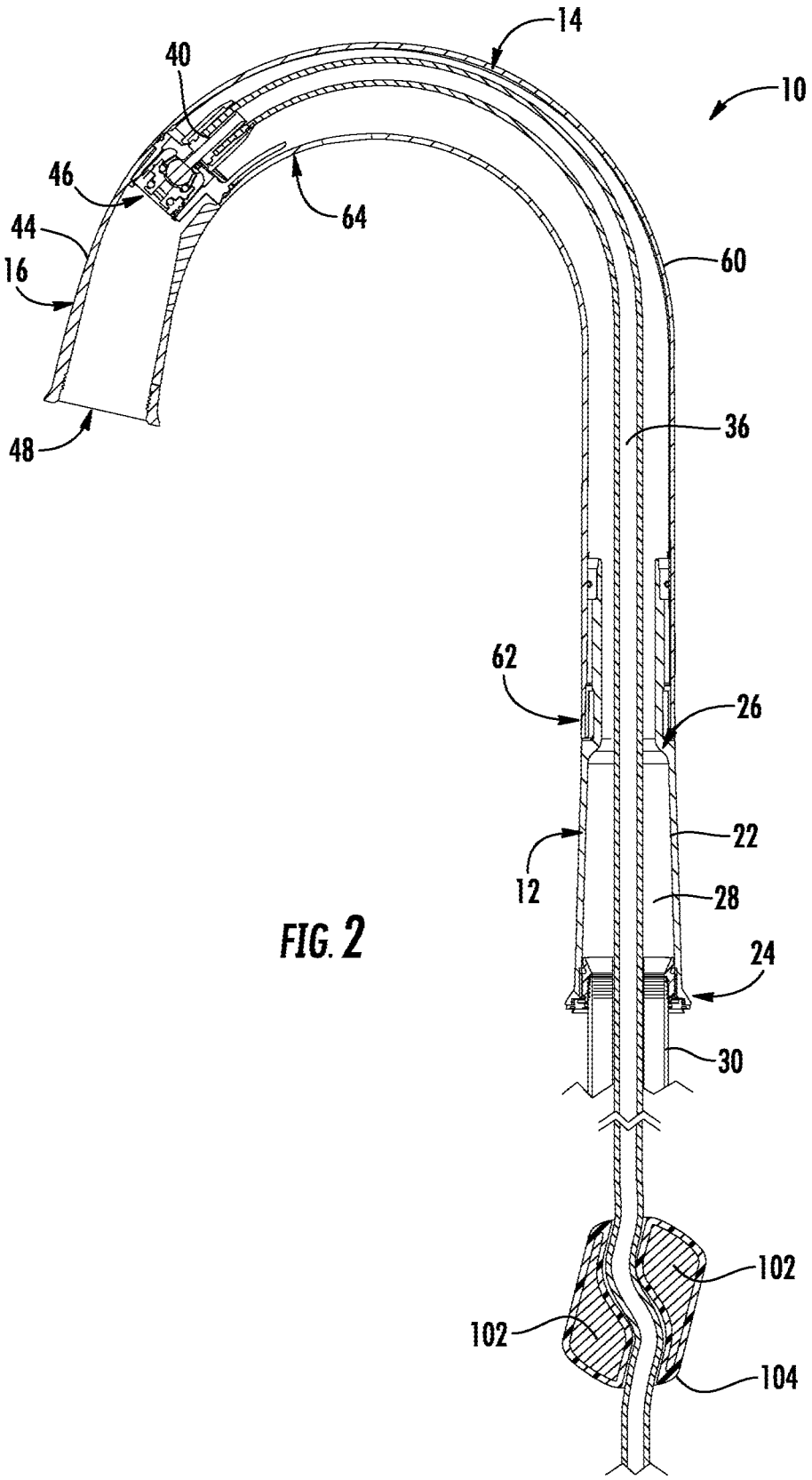
FIG. 2 is a cross-sectional plan view of the faucet of FIG. 1A.

Referring to FIG. 2, the base 12 includes a sidewall 22, extending between a first or bottom end 24 to a second or top end 26, and an axially extending cavity 28. The bottom end 24 is configured to provide stable support to the faucet 10 when coupled to a surface (e.g., countertop, wall, bar, table, support structure, etc.). A stem 30 may be threadedly coupled to the bottom end 24 to extend through the surface and to couple to a clamping mechanism 32 configured to couple the stem 30 to an opposite side (e.g., underside, inside, etc.) of the surface. According to an exemplary embodiment, the surface is a sink or countertop over a cabinet, the countertop receiving the sink therein.

Referring still to FIG. 2, the sidewall 22 is shown to at least partially define the cavity 28, which is configured to receive and permit the passage therethrough of water lines (not shown). For example, the cavity 28 may receive a cold water line (not shown) and a hot water line (not shown). The faucet 10 further includes an outlet line, shown as hose 36, according to an exemplary embodiment. The hose 36 is configured to carry water through the spout 14 to the sprayhead 16 and is sufficiently flexible to permit the hose to travel through the shape of the spout 14 while the sprayhead 16 is moved between the docked and undocked position. According to the exemplary embodiment shown, the hose 36 extends from a first or inlet end 38, which fluidly couples to the valve, to a second or outlet end 40, which fluidly couples to the sprayhead 16.

Further referring to FIG. 2, the sprayhead 16 includes a sidewall 44 extending between a first or inlet end 46 and a second our outlet end 48. The sprayhead 16 transfers fluid from the hose 36 to an outlet port. For example, the sprayhead 16 may include an aerator and one or more non-aerated nozzles. A diverter mechanism controlled by a switch may transition the flow between modes, e.g., divert flow to the aerator, to the nozzles, or pause the flow of fluid through the sprayhead 16.

The spout 14 includes a sidewall 60 extending from a first or bottom end 62 to a second or top end 64. The bottom end 62 couples to the top end 26 of the base 12. According to other embodiments, the spout 14 may be fixed to the base 12, but according to the embodiment shown, the spout 14 is rotatably coupled to the base 12 to provide direction and range of the outlet flow of fluid to the environment, i.e., provides a greater usable work area. The top end 64 is configured to releasably couple to the sprayhead 16.

Figure 3:
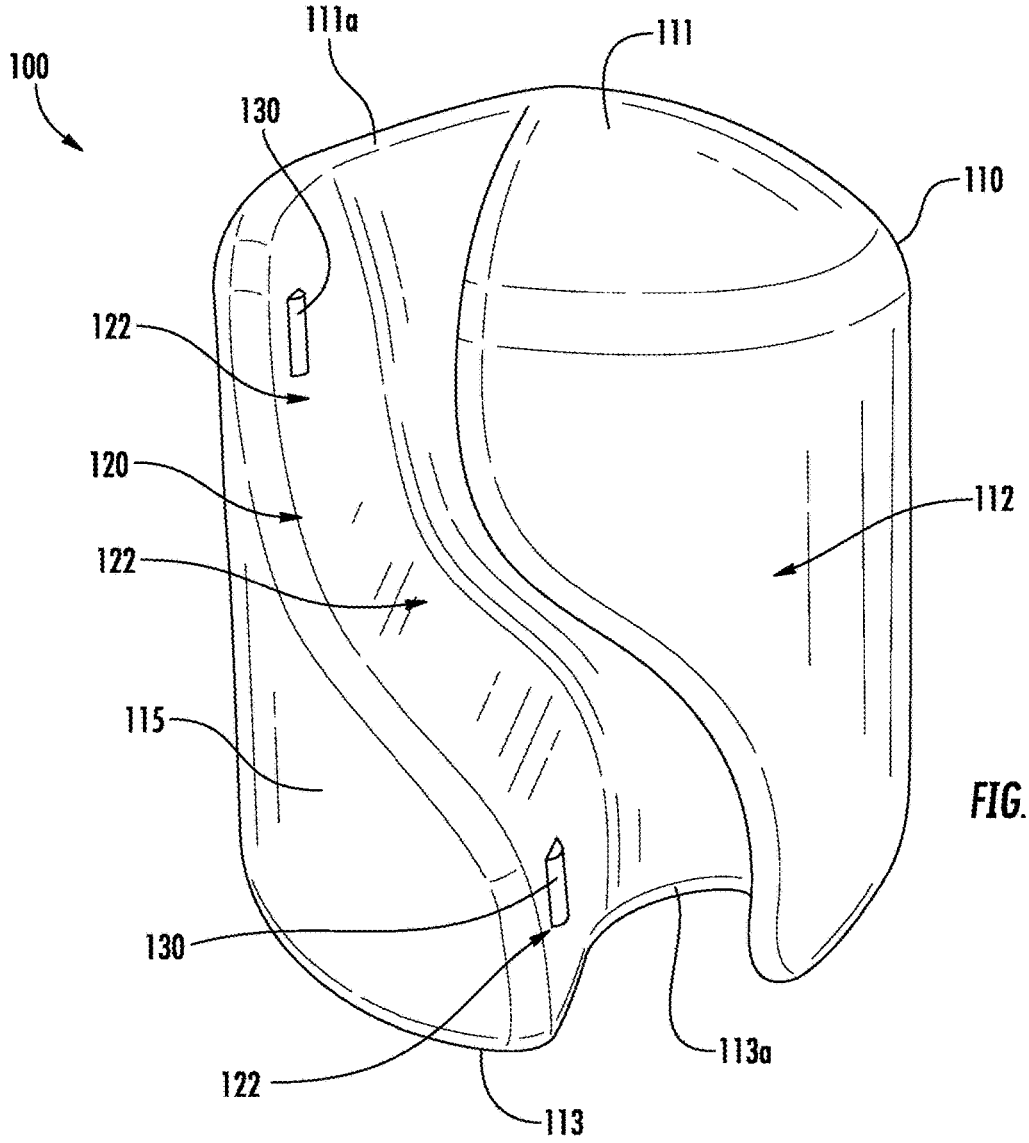
FIG. 3 is a perspective view of the pulldown weight, according to an exemplary embodiment.
Figure 5:
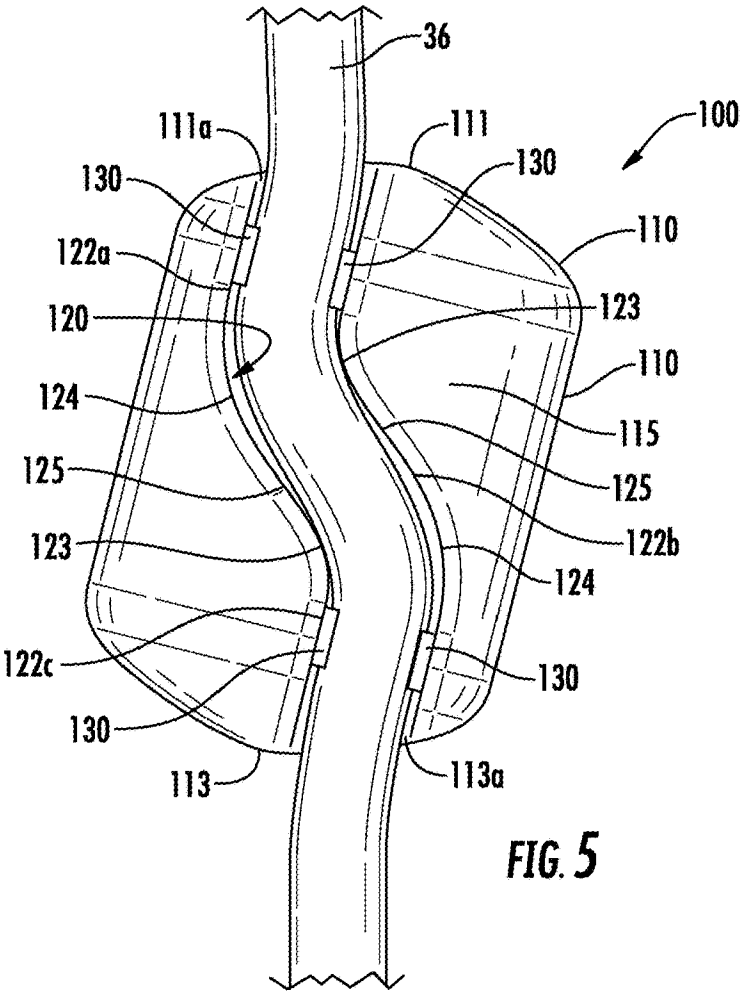
FIG. 5 is a view of the pulldown weight of FIG. 3 installed on a hose.
Figure 4:
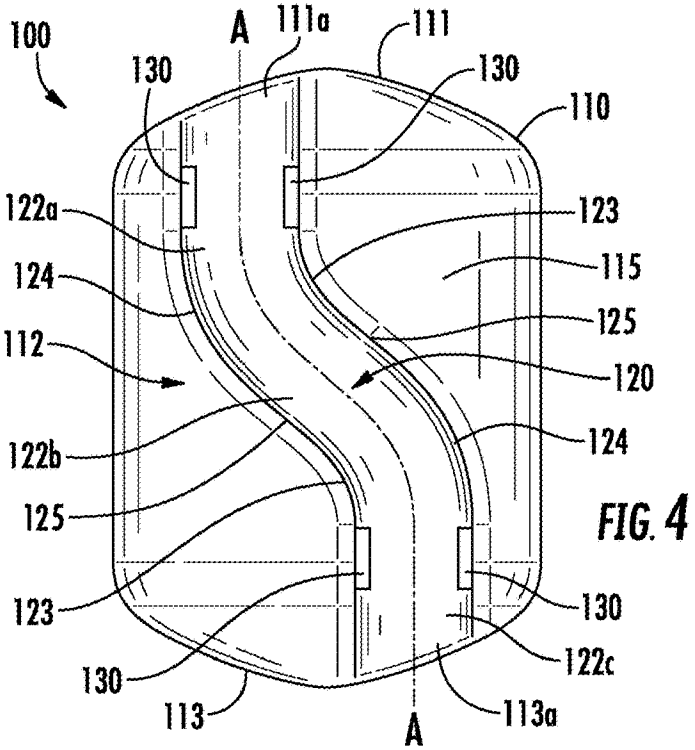
FIG. 4 is a front elevation view of the pulldown weight of FIG. 3.

Referring now to FIGS. 3-5, a pulldown weight 100 for a faucet 10 is shown according to an exemplary embodiment. The weight 100 includes a body 110 defining a channel 120 in the front surface 115 of the body 110, the channel 120 configured to receive and frictionally engage the hose 36. The body 110 may be formed from a core 102 and a shell 104 (e.g., over mold, coating, etc.) disposed about the core 102. According to an exemplary embodiment, the core 102 may be formed from metal (e.g., steel) or other material to provide the weight 100 with substantially sufficient mass to return the sprayhead to the docked position. The shell 104 may be formed from a material (e.g., plastic) selected to provide a desired frictional resistance with the hose 36 to fix the weight 100 at a stationary position along (i.e., relative to) the hose 36. According to another exemplary embodiment, the core 102 may be integrally formed with the shell 104 from a single material to form the body 110. The body 110 may be formed from an epoxy or composite material (e.g., Neoroc™, etc.). For example, a body 110 with an integrally-formed core 102 and shell 104 may be formed of a mixture including epoxy and a weight material including at least one of cast iron shavings or foundry sand to increase the mass of the weight 100. According to other exemplary embodiments, the epoxy may be mixed with another weight material (e.g., material recycled from the manufacturing process) for increasing the mass of the weight 100. The epoxy may be mixed with the shavings, sand, or other material to form a substantially homogeneous mixture, and poured into a mold for forming the weight 100. The materials for forming the hose 36 and the body 110 may be selected to increase friction between the hose 36 and the channel 120. For example, the hose 36 may be formed from polyester or nylon.

According to an exemplary embodiment, the weight 100 defines a one-piece body, such that no additional components (e.g., clamshell structure) are required for installation. For example, the weight 100 may be installed on a hose 36 without assembling or disassembling portions of the body 110. Furthermore, the weight 100 may be installed on the hose 36 without using any fasteners (e.g., adhesive, screw, compression nut, etc.).

Referring to FIGS. 1A and 1B, the weight 100 may be coupled to the hose 36 to help balance the sprayhead 16 and to retract the hose 36 into the spout 14. The weight may have a mass that is substantially the same as or greater than a mass of the sprayhead 16. The mass of the weight 100 may be determined based on a desired retraction force on the sprayhead 16, for example, to provide a desired "feel" for the return of the sprayhead 16 to the spout 14. According to an exemplary embodiment, the mass of the weight 100 may be substantially the same as or greater than the mass of the sprayhead 16 and a length of the hose 36 extending out from the spout 14 when the sprayhead 16 is in the undocked position. When the sprayhead 16 is in the docked position, the weight 100 may be installed at a position along the hose 36 between a lower apex 39 of the hose 36 and the stem 30, for example, proximate the apex 39. According to an exemplary embodiment, the weight 100 may be installed at a position along the hose 36 such that that length of hose 36 between the weight 100 and the stem 30 when the sprayhead 16 is in the docked position is substantially the same as a maximum desired distance that the sprayhead 16 may be withdrawn from the spout 14.

A cross-sectional shape of the channel 120 is configured to correspond to an outer surface of the hose 36. For example, the cross-sectional shape may be substantially arcuate (i.e., semi-circular), configured to receive the hose 36 through an open end of the arc defined in the front surface 115, although according to other exemplary embodiments, the channel 120 may define other cross-sectional shapes (e.g., square, ovular, trapezoidal, etc.). According to an exemplary embodiment, the cross-sectional shape of the channel 120 defines a diameter, which may be substantially the same as or greater than a diameter of the outer surface of the hose 36. According to another exemplary embodiment, the diameter of the channel 120 may be less than the diameter of the hose 36, such that the channel 120 is configured to hold the hose 36 with a compression fit. As shown in FIGS. 3 and 4, the diameter of the channel 120 may be substantially constant, although according to other exemplary embodiments, the diameter of the channel 120 may vary along a length of the channel 120.

The channel 120 (e.g., cross-sectional diameter) defines an axis A-A having a non-linear path. The channel 120 includes a plurality of portions 122 along the axis A-A defining the shape of the channel 120. As shown in FIGS. 3 and 4, the channel 120 includes at least a first portion 122*a*, a second portion 122*b*, and a third portion 122*c*, the second portion 122*b* extending angularly between and connecting the first and third portions 122*a*, 122*c*. As shown in FIGS. 3 and 4, the channel 120 defines a generally "S" shape, such that the third portion 122*c* is substantially parallel to and axially offset from the first portion 122*a*. The first portion 122*a* extends from an opening 111*a* in a first end 111 of the body 110 toward an inner region 112 thereof. The third portion 122*c* extends from an opening 113*a* in a second end 113 of the body 110 toward the inner region 112. In an exemplary embodiment defining an "S" shape, the first end 111 and second end 113 may be opposing (e.g., substantially parallel) ends of the body 110, although according to other exemplary embodiments, the first and second ends 111, 113 may be offset at other angles (e.g., 90 degrees). In at least the "S" configuration shown in FIGS. 3-5, the second portion 122*b* is oriented at an angle relative to each of the first and third portions 122*a*, 122*c* and defines an inflection point 125 therebetween.

According to other exemplary embodiments, the first and third portions 122*a*, 122*c* may have other orientations. For example, the channel 120 may define a generally "C" shape. In this configuration, the first portion 122*a* may be substantially parallel and offset from the third portion 122*c*. In this configuration, the second portion 122*b* defines an arc (e.g., semi-circle) extending between the first and second portions 122*a*, 122*c*, but may not include an inflection point 125 in the channel 120.

According to other exemplary embodiments, the channel 120 may define other shapes (e.g., "omega", "L"). While FIGS. 3-5 show a channel 120 having three portions 122, according to other exemplary embodiments, the channel 120 may include more or fewer portions 122. According to an exemplary embodiment, the resistance between the channel 120 and the hose 36 may be increased by providing additional portions 122, such that each additional portion 122 is configured to provide an additional inflection point 125 in the channel 120.

Referring generally to FIGS. 1-3 and specifically to FIG. 5, the weight 100 is configured to receive the hose 36 in the channel 120. The hose 36 may be configured to straighten (i.e., unbend) when no load is applied thereto. For example, when a length of hose 36 is bent and subsequently released, the hose 36 may return (i.e., rebound) to a substantially straight orientation. As shown in FIG. 5, the hose 36 is inserted into the channel 120 in a first (i.e., bent) profile. In a second (i.e., straightened) profile, the hose 36 may apply a substantially lateral force to an inner radius (i.e., first inner radius) 123 of the channel 120 between the first portion 122*a* and the second portion 122*b*. The hose 36 may also apply a substantially lateral force to an inner radius (i.e., second inner radius) 123 of the channel 120 between the second portion 122*b* and the third portion 122*c*. In the configuration shown in FIG. 5, the lateral forces applied at each of the inner radii 123 may be in opposing directions. These lateral forces provide static friction between the hose 36 and the channel 120. The static friction may be increased by increasing the rigidity of the hose 36, which in turn increases the lateral force on the inner radii 123. According to another exemplary embodiment, the channel 120 includes more portions 122. The hose 36 is configured to frictionally engage at least one inner radius 123 defined by the channel 120 for each additional portion 122 that generates an inflection point 125. According to another exemplary embodiment, where the channel 120 defines a generally "C" shape (i.e., no inflection points), the hose 36 may be configured to apply a substantially lateral force and frictionally engage an outer radius 124 of the channel 120.

The hose 36 may be received in the channel 120 by feeding (i.e., pressing) the hose 36 laterally through the front surface 115 into the channel 120 with the weight 100 positioned at the desired location along the hose 36. Before the hose 36 is fed into the channel 120, it may be bent into the first profile corresponding with (i.e., complementary to) the channel 120. Once the hose 36 is disposed in the channel 120, it may be released and partially rebound (i.e., unbend, straighten) into the second profile, which is more linear than the first profile. As shown in FIG. 5, when the weight 100 is installed, it may be askew (i.e., rotated) relative to the length of hose 36 extending away from each end 111, 113 of the body 110. According to another exemplary embodiment, the inlet end 38 of the hose 36 may be fed through the channel 120 from the first end 111 of the body 110 to the second end 113 of the body 110. A user may adjust the position of the weight 100 along the hose by applying enough force to either of the first or second ends 111, 113 of the body 110 to overcome frictional resistance defined between the hose 36 and the channel 120. According to an exemplary embodiment, the weight 100 may be repositioned by bending the length of the hose 36 disposed in the channel 120 to the first profile, such that the lateral force imposed by the hose 36 on the inner radii 123 is reduced or eliminated. The weight 100 may then be slid and repositioned along the hose 36 more easily. Once the weight 100 is placed in the desired position, the hose 36 may be released and reengage the channel 120 at the inner radii 123.

Referring further to FIGS. 3-5, the weight 100 is shown to include a plurality of tabs (i.e., ribs, lugs, etc.) 130 proximate to the front surface 115, extending into the channel 120 and configured to retain the hose 36 within the channel. The tabs 130 may be integrally formed with the body 110 or may be separately formed and connected to the body 110 either before or after installing the hose 36 within the channel 120. The tabs 130 are configured to extend from the channel 120 to define an opening having a smaller width than the diameter of the hose 36. For example, FIG. 5 shows sets of opposing tabs 130. The space between each of the opposing tabs 130 is less than the diameter of the hose 36. This configuration provides an interference fit for retaining the hose 36 within the channel 120. According to an exemplary embodiment, the hose 36 is deformable such that the hose 36 locally deforms as it engages the tabs 130 while being fed past the tabs 130 and received in the channel 120. According to another exemplary embodiment, the tabs 130 may be deformable.

As shown in FIGS. 3-5, the plurality of tabs 130 includes opposing tabs 130 in each of the first portion 122*a* and third portion 122*c* of the channel 120. According to an exemplary embodiment, tabs 130 may be defined in more or fewer portions 122 (e.g., in the second portion 122*b* and/or any additional portions 122). According to another exemplary embodiment, each portion 122 may include more or fewer tabs 130. Each tab 130 may be oriented on a side of the channel 120 where the hose 36 engages to the channel 120, enhancing retention of the hose 36 within the channel 120.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of this disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the position of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is to be understood that although the present invention has been described with regard to preferred embodiments thereof, various other embodiments and variants may occur to those skilled in the art, which are within the scope and spirit of the invention, and such other embodiments and variants are intended to be covered by corresponding claims. Those skilled in the art will readily appreciate that many modifications are possible (e.g., variations in sizes, structures, shapes and proportions of the various elements, mounting arrangements, use of materials, orientations, manufacturing processes, etc.) without materially departing from the novel teachings and advantages of the subject matter described herein. For example, the order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. A weight for a faucet hose comprising:

a body defining a channel extending from a front surface into the body, the channel having a non-linear axis;

a hose disposed in and frictionally engaging the channel, the hose having a diameter the same as or less than a diameter of the channel; and a pair of opposing tabs extending into the channel and defining an opening width therebetween proximate the front surface of the body, the opening width less than the diameter of the hose;

wherein the pair of tabs is configured to retain the hose in the channel.

2. The weight of claim 1, wherein the channel comprises a first portion, a second portion, and a third portion, the second portion extending between the first portion and the third portion; and wherein the second portion defines an inflection point between the first portion and the third.

3. The weight of claim 2, wherein the third portion is substantially parallel to, and axially offset from, the first portion.

4. The weight of claim 2, wherein a first inner radius is defined between the first portion and the second portion;

wherein a second inner radius opposing the first inner radius is defined between the second portion and the third portion; and wherein the first inner radius and the second inner radius are configured to frictionally engage the hose.

5. The weight of claim 1, wherein the channel defines a generally "S" shape.

6. The weight of claim 1, wherein the body is integrally formed.

7. The weight of claim 1, wherein the weight is configured to engage the hose without a fastener.

8. The weight of claim 1, wherein the body is formed from a mixture of epoxy and at least one weight material.

9. A faucet assembly comprising:

a weight defining a channel extending from a front surface into the body, the channel comprising:

a first portion;

a second portion extending angularly from the first portion;

a third portion extending angularly from the second portion and axially offset from the first portion;

a first inner radius defined between the first portion and the second portion; and a second inner radius defined between the second portion and the third portion, the second inner radius opposing the first inner radius;

a hose fluidly connected to a faucet and having a diameter the same as or less than a diameter of the channel, the hose received in and frictionally engaging the channel at the first inner radius and the second inner radius; and a pair of opposing tabs extending into the channel and defining an opening width therebetween proximate the front surface of the body;

wherein the opening width is less than the diameter of the hose; and wherein the pair of tabs is configured to retain the hose in the channel.

10. The faucet assembly of claim 9, wherein the second portion defines an inflection point between the first portion and the third portion.

11. The faucet assembly of claim 9, wherein the hose is formed from a flexible material configured to bend under load and configured to straighten when released.

12. The faucet assembly of claim 9, wherein the hose is configured to form a first profile complementary to the channel when the hose is received in the channel through a front surface of the weight.

13. The faucet assembly of claim 12, wherein the hose is configured to form a second profile straighter than the first profile when the hose is released in the channel.

14. A method of making a faucet hose with a weight comprising:

bending the hose, such that the hose forms a first profile generally complementary to a non-linear channel defined in a front surface of the weight;

passing the hose through the front surface toward the channel;

deforming the hose such that it passes a pair of opposing tabs extending into the channel and defining an opening width therebetween proximate the front surface;

releasing the hose, such that the hose rebounds into a second profile configured to engage the channel and a diameter of the hose greater than the opening width and the same as or less than a diameter of the channel;

wherein the second profile is more linear than the first profile; and wherein the plurality of tabs retain the hose in the channel.

15. The method of claim 14, wherein the channel defines a first inner radius and a second inner radius opposing the first inner radius;

wherein the hose engages the channel at the first inner radius and the second inner radius.

16. The method of claim 14, wherein the channel is generally "S" shaped.

* * * * *